US010954936B2

(12) United States Patent
Apperger

(10) Patent No.: US 10,954,936 B2
(45) Date of Patent: Mar. 23, 2021

(54) AXIAL PISTON MACHINE WITH RECESS IN THE REGION OF THE LOADING PRESSURE CHANNEL

(71) Applicant: Robert Bosch GmbH, Stuttgart (DE)

(72) Inventor: Andreas Apperger, Eutingen (DE)

(73) Assignee: Robert Bosch GmbH, Stuttgart (DE)

( * ) Notice: Subject to any disclaimer, the term of this patent is extended or adjusted under 35 U.S.C. 154(b) by 132 days.

(21) Appl. No.: 16/420,606

(22) Filed: May 23, 2019

(65) Prior Publication Data

US 2019/0360482 A1 Nov. 28, 2019

(30) Foreign Application Priority Data

May 23, 2018 (DE) ..... 10 2018 208 069.0

(51) Int. Cl.
*F04B 1/28* (2006.01)
*F04B 49/14* (2006.01)
*F04B 1/295* (2020.01)

(52) U.S. Cl.
CPC ..... *F04B 49/14* (2013.01); *F04B 1/28* (2013.01); *F04B 1/295* (2013.01)

(58) Field of Classification Search
CPC .. F04B 1/28; F04B 1/295; F04B 49/14; F01B 3/102; F15B 15/149; F15B 15/1438
See application file for complete search history.

(56) References Cited

U.S. PATENT DOCUMENTS 3,148,595 A * 9/1964 Looney ..... F15B 15/24 92/11
3,293,994 A * 12/1966 Napolitano ..... F15B 15/1433 92/86
4,936,095 A * 6/1990 Ross ..... F16H 39/14 60/444

(Continued)

FOREIGN PATENT DOCUMENTS

DE 36 28 442 A1 2/1988
DE 11 2016 006 012 T5 9/2018

OTHER PUBLICATIONS

Rexroth Bosch Group Reversible A10VER axial piston variable motor for hydrostatic fan drives' Series 52 instruction manual RE 91706-01-B/09.2015 (Year: 2015).*

(Continued)

*Primary Examiner* — Patrick Hamo
*Assistant Examiner* — Joseph S. Herrmann
(74) *Attorney, Agent, or Firm* — Maginot, Moore & Beck LLP

(57) ABSTRACT

An axial piston machine includes a housing, an actuating piston, and a closing screw. The housing includes a cylinder bore, a recess, and a fluid channel. An end of the bore open to an outside of the housing has an internal thread. The recess is located in a region of the internal thread, and is deeper than a thread depth of the internal thread so that a floor region of the recess is free from thread turns. The piston is linearly moveable in the cylinder bore, and is configured to adjust a displacement volume of the machine.

(Continued)

The screw is screwed into the internal thread so as to form a closed chamber between the piston and the screw. The fluid channel opens into the floor region of the recess, and is fluidically connected to the cylinder chamber.

6 Claims, 3 Drawing Sheets

(56) References Cited

U.S. PATENT DOCUMENTS

| | | | | |
|---|---|---|---|---|
| 6,640,689 | B2 * | 11/2003 | Mitsui | F15B 13/081 92/136 |
| 6,662,558 | B1 * | 12/2003 | Nelson | F04B 1/28 60/443 |
| 2017/0211555 | A1 * | 7/2017 | Ueda | F04B 1/2078 |
| 2019/0063471 | A1 * | 2/2019 | Hara | B23P 11/005 |

OTHER PUBLICATIONS

German Search Report corresponding to DE Application No. 10 2018 208 069.0, dated Jan. 11, 2019, German Language (10 pages).
Bosch Rexroth Instruction Manual for Reversible A1OVER Axial piston variable motor for hydrostatic fan drives, Series 52, RD 91706-01-B/09.2015 (pp. 1-56 in German) and RE 91706-01-B/09. 2015 (pp. 57-112 in English).

* cited by examiner

AXIAL PISTON MACHINE WITH RECESS IN THE REGION OF THE LOADING PRESSURE CHANNEL

This application claims priority under 35 U.S.C. § 119 to patent application no. DE 10 2018 208 069.0, filed on May 23, 2018 in Germany, the disclosure of which is incorporated herein by reference in its entirety.

The disclosure concerns an axial piston machine.

BACKGROUND

The catalogue which, on Oct. 4, 2018, could be retrieved under the Internet address http://www.boschrexroth.com/various/utilities/mediadirectory/download/index.jsp?object_nr=R D91706-01-B, discloses an axial piston machine. This is operated as a motor, wherein the present disclosure may also be used for pumps. This axial piston machine is configured in a swash plate design, wherein the present disclosure may also be used for axial piston machines with bent axis design.

SUMMARY

The axial piston machine has an actuating piston by means of which the displacement volume of the axial piston machine can be adjusted. In the present case, the actuating piston adjusts the pivot cradle. In an axial piston machine with bent axis design, the actuating piston could also move the control lens.

An advantage of the present disclosure is that for a cylinder bore with given dimensions, a particularly large actuation travel of the actuating piston can be achieved. Here the strength of the axial piston machine, in particular the housing, is not disadvantageously changed. The axial piston machine may be operated with unchanged operating pressure.

According to the disclosure, it is provided that in the region of the internal thread, a recess is arranged which is deeper than a thread depth of the internal thread, so that a floor region of the recess is free from thread turns, wherein the fluid channel opens into said floor region. The fluid channel preferably opens completely in the floor region, wherein most preferably it is arranged at a distance from the edge of the floor region.

Preferably, the fluid channel is connected to a control valve, by means of which, for example, the delivery pressure of the axial piston machine can be set to a predefined value by adjusting the displacement volume. The fluid channel is accordingly also known as a loading pressure channel.

The claims, description, and drawings indicate advantageous refinements and improvements of the disclosure.

It may be provided that the recess, when viewed in a sectional plane oriented perpendicularly to the center axis of the cylinder bore and passing through the fluid channel, is configured so as to be circular so that its width in the region of the thread tips of the internal thread is at least twice as large as the diameter of the fluid channel. Such a recess can be produced particularly easily and economically with a side milling cutter or a ball cutter. The material stress in the region of the recess is lower, the larger the outer diameter of said cutter. It is understood that this outer diameter is preferably selected so large that the material strength is adequate.

It may be provided that the recess, when viewed in a sectional plane containing the center axis of the cylinder bore and passing through the fluid channel, is configured so as to be trapezoid, wherein the fluid channel opens fully in the corresponding flat floor region. This gives a clearly delimited floor region. The floor region is preferably arranged parallel to the center axis of the cylinder bore.

It may be provided that the recess, when viewed in a sectional plane containing the center axis of the cylinder bore and passing through the fluid channel, is configured so as to be circular. This gives a particularly low material stress in the region of the fluid channel. The corresponding recess may for example be produced using a ball cutter.

It may be provided that the recess is configured so as to be rotationally symmetrical relative to an axis of symmetry which runs parallel to the center axis of the cylinder bore and is arranged in the interior of the cylinder bore. Such a recess can easily be produced with a side milling cutter or ball cutter.

It is understood that the features presented above and to be explained below may be used not only in the combination given but also in other combinations or alone without leaving the scope of the present disclosure.

BRIEF DESCRIPTION OF THE DRAWINGS

The disclosure is explained in more detail below with reference to the enclosed drawings. The drawings show.

DETAILED DESCRIPTION

Figure 1:
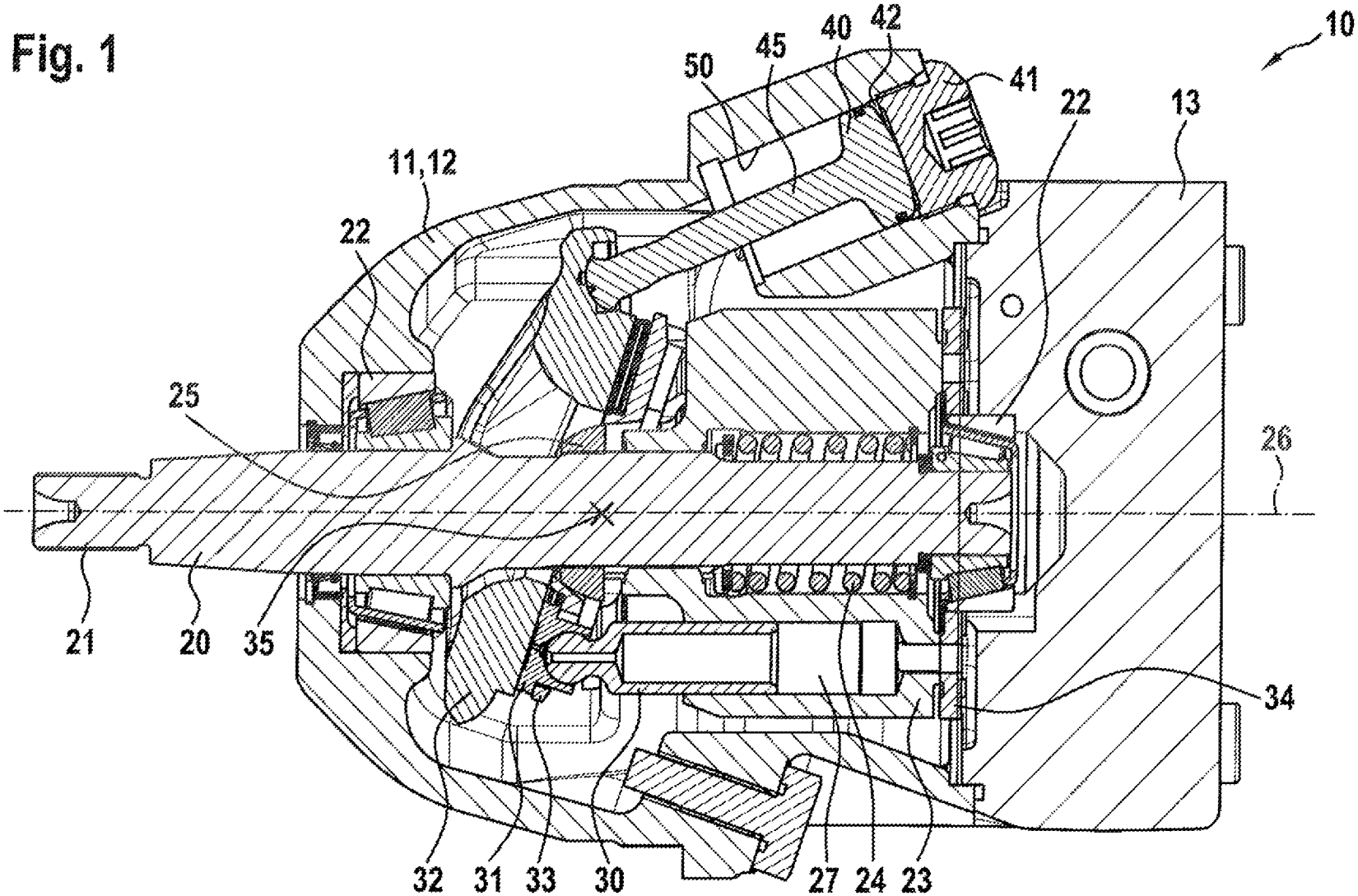
FIG. 1 a longitudinal section through an axial piston machine according to the disclosure.

FIG. 1 shows a longitudinal section through an axial piston machine 10 according to the disclosure. The axial piston machine 10 comprises a housing 11 which has a housing base body 12 and a connecting plate 13. The housing base body 12 is formed as a pot, wherein its opening is closed by the connecting plate 13. Two fluid connections, not visible in FIG. 1, namely a suction connection and a pressure connection, are provided in the connecting plate 13.

A drive shaft 20 is mounted in the housing 11 so as to be rotatable relative to a rotation axis 26 by means of two rotary bearings 22. The rotary bearings 22 in the present case are formed as tapered roller bearings. The drive shaft 20 protrudes from the housing 11 with a drive journal 21 so that it can be brought into a rotary drive connection with an electric motor for example. A cylinder drum 23 is arranged around the drive shaft 20 between the two rotary bearings 22, and stands in rotary drive connection with the drive shaft 20. In the pressureless state, the cylinder drum 23 is pressed by a spring 24 against a control plate 34 which in turn bears on the connecting plate 13. In operation, a hydraulic contact force also applies. The control plate 34 is provided with at least two control openings which are each fluidically connected to an assigned fluid connection. The control plate 34 preferably consists of brass. It is connected rotationally fixedly to the connecting plate 13, wherein the cylinder drum 23 is rotatable relative to the control plate 34.

Several working pistons 30 are contained in the cylinder drum 23. The working pistons 30 are evenly distributed around the rotation axis 26 and oriented substantially parallel thereto. The working pistons 30 together with the cylinder drum 23 each delimit a working chamber 27 with variable volume. By rotating the cylinder drum 23, the working chambers 27 can be brought alternately into fluid-exchange connection with one of the control openings in the control plate 34.

One end of each working piston 30 protrudes from the cylinder drum 23 and is fitted with a tiltable slide shoe 31. The slide shoe 31 slides on a flat slide surface on a pivot cradle 32 and is pressed against the pivot cradle 32 by the pressure in the working chambers. So that the slide shoes 31 follow the position of the pivot cradle 32 even in a pressureless state, a retraction plate 33 is provided which rests on a ball-like face of a pressure ring 25. The pressure ring 25 is preferably fixedly connected to the drive shaft 20.

The pivot cradle 32 is mounted in the housing base body 12 so as to be pivotable about a pivot axis 35, for example by means of two plain bearings. The pivot axis 35 runs perpendicularly to the rotation axis 26, wherein it either intersects this or is arranged at a slight distance therefrom.

The housing 11 is provided with a cylinder bore 50 in which an actuating piston 40 is mounted so as to be linearly movable. The actuating piston 40 is formed with an integral piston rod 45, the end of which bears on the pivot cradle 32. The comparatively thin piston rod 45 allows a slight tilting of the actuating piston 40 so that it does not seize when the pivot cradle 32 shifts.

The cylinder bore 50 is closed towards the outside by a closing screw 41 so as to create a cylinder chamber 42, which is closed fluid-tightly, between the closing screw 41 and the actuating piston 40. When this is pressurized via the fluid channel (no. 43 in FIG. 2), the actuating piston 40 moves towards the pivot cradle 32 so the pivot cradle 32 is adjusted. Consequently, the displacement volume of the axial piston machine 10 changes.

A return force directed against the actuating force of the actuating piston 40 may be achieved by means of a return spring (not shown) at the pivot cradle 32 and/or by the eccentric arrangement of the pivot axis 35.

Figure 2:
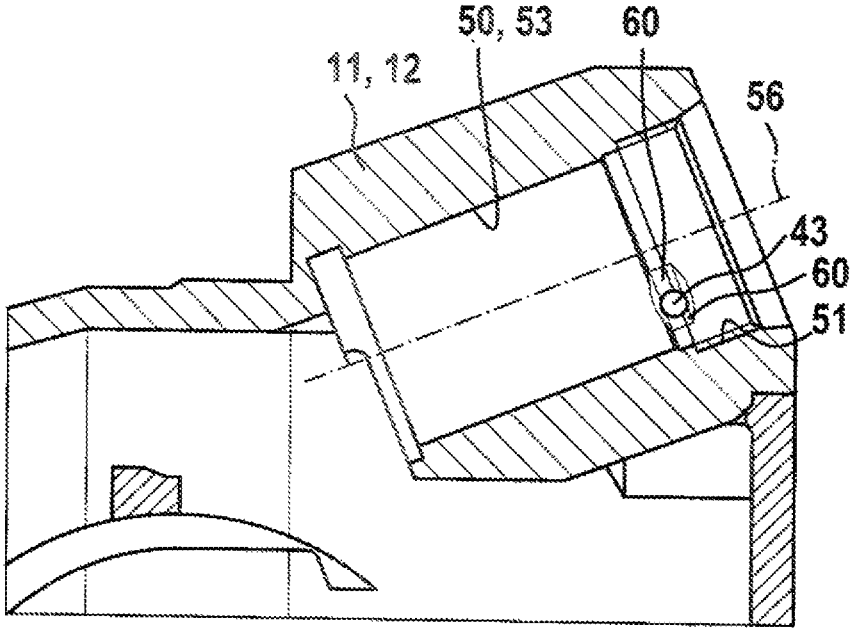
FIG. 2 a partial longitudinal section of the housing of the axial piston machine from FIG. 1.

FIG. 2 shows a partial longitudinal section of the housing 11 of the axial piston machine 10 according to FIG. 1. The sectional plane is the same as that in FIG. 1. The drawing shows the cylinder bore 50, which is configured so as to be circular cylindrical relative to a center axis 56, in a circular cylindrical region 53. The actuating piston 40 lies in sealed fashion in this smooth region 53. An internal thread 51 directly adjoins the circular cylindrical region 53. The closing screw (no. 41 in FIG. 1) is screwed in here and closes the cylinder bore 50 towards the outside. Normally, the fluid channel 43 opens into the circular cylindrical region 53 since this location is optimal for strength reasons.

In the context of the present disclosure, in a cylinder bore 15 with given dimensions, a particularly large actuation travel of the actuating piston 40 is achieved. Therefore, the fluid channel 43 is relocated into the region of the internal thread 51. It has been found that the strength of the material of the housing 11 there is no longer sufficient to permanently bear the material stresses occurring during operation. To remedy this problem, the recess 60 according to the disclosure is made, the shape of which will be explained in more detail with reference to FIGS. 3 to 5.

Figure 3:
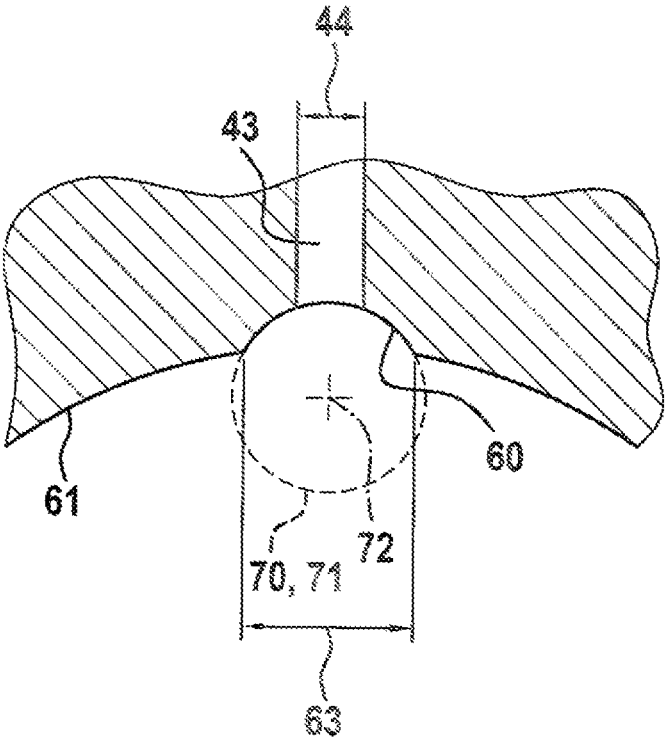
FIG. 3 a roughly diagrammatic, partial section of the axial piston machine from FIG. 1 in the region of the recess.

FIG. 3 shows a partial section of the axial piston machine 10 from FIG. 1 in the region of the recess 60. The sectional plane is oriented perpendicularly to the center axis of the cylinder bore and runs through the fluid channel 43. The fluid channel 43 typically has a circular cross-sectional form with diameter 44. The recess according to the disclosure may be produced for example by means of a side milling cutter, the rotation axis which runs parallel to the center axis of the cylinder bore so that it can easily be inserted therein. The recess 60 is therefore rotationally symmetrical relative to an axis of symmetry 72 which coincides with said rotation axis.

The outer diameter 71 of the side milling cutter, or the milling cutter diameter, is significantly larger than the diameter 44 of the fluid channel 43. Accordingly, the width 63 of the recess 60 in the region of the thread tips (no. 55 in FIG. 4) is at least twice as large as the diameter 44 of the fluid channel 43.

Figure 4:
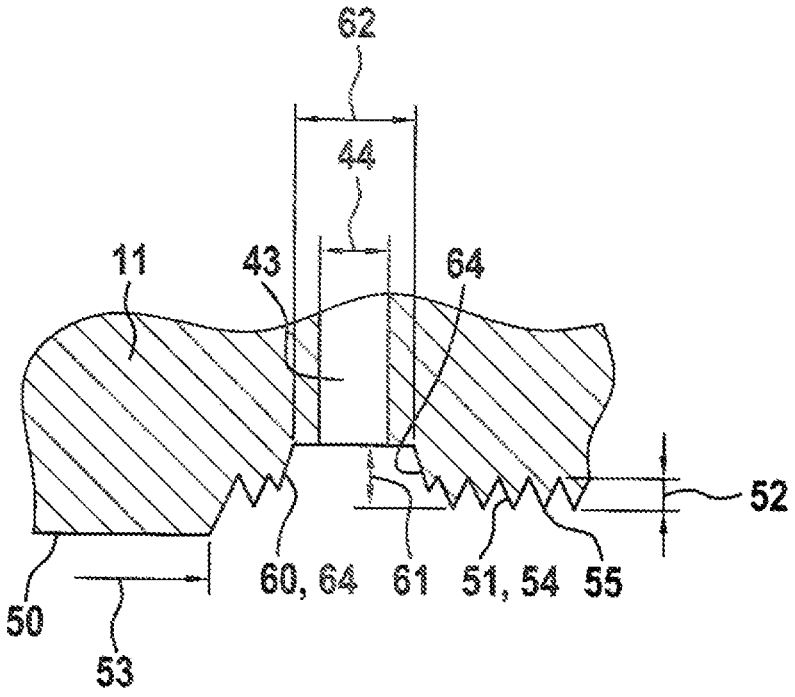
FIG. 4 a further roughly diagrammatic, partial section of the axial piston machine from FIG. 1 in the region of the recess.

FIG. 4 shows a further roughly diagrammatic, partial section of the axial piston machine from FIG. 1 in the region of the recess 60. The sectional plane contains the center axis of the cylinder bore 50 and passes through the fluid channel 43. In relation to the sectional plane, the cross-sectional form of the recess 60 is trapezoid. The floor region 62 runs parallel to the center axis of the cylinder bore. The fluid channel 43 opens completely there. The depth 61 of the recess 60 is formed larger than the thread depth 52. Accordingly, no thread turns 54 are present in the floor region 62, nor any residual part of a thread turn 54. The two depths 61; 52 are measured starting from the thread tip 55 and from the inner diameter of the internal thread 51 respectively.

The two opposing side walls 64 of the recess 60 are formed sloping. The flatter the slope, the lower the material stresses occurring in operation.

FIG. 4 also shows that the internal thread 51 directly adjoins the circular cylindrical region 53. Typically, the inner diameter of the circular cylindrical region 53 is formed slightly smaller than the inner diameter of the internal thread 51, so that the thread tips 55 are not flush with the circular cylindrical region 53.

Figure 5:
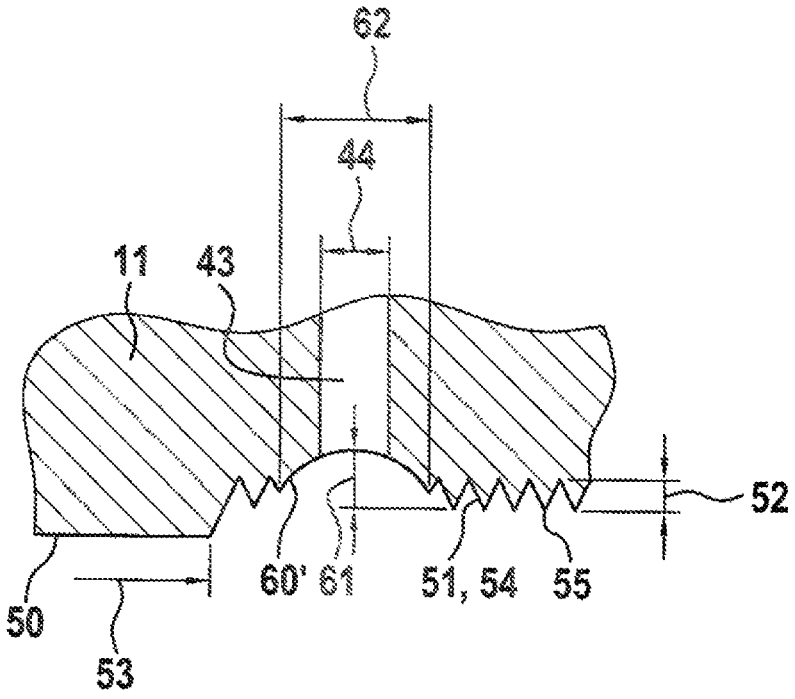
FIG. 5 a partial section, corresponding to FIG. 4, of a further embodiment of the recess.

FIG. 5 shows a partial section, corresponding to FIG. 4, of a further embodiment of the recess 60'. The second embodiment differs from the first embodiment in FIGS. 1 to 4 solely in that the cross-sectional form of the recess 60' in the present sectional plane is no longer trapezoid but circular. The floor region 62 is thereby no longer delimited in defined fashion. It is rather defined as the region in which no thread turns 54 are present nor any residual part of thread turns 54. The fluid channel 43 opens completely there.

The circle radius of the cross-sectional form in FIG. 5 may, as shown, be smaller than the circle radius of the cross-sectional form in FIG. 3. It is however also conceivable that the two circle radii are formed identically. The corresponding recess 60' may for example be produced using a ball cutter. Its rotation axis need not be oriented parallel to the center axis of the cylinder bore. It is preferably selected such that the ball cutter, in particular its shank, does not collide with the housing.

LIST OF REFERENCE SIGNS

10 Axial piston machine
11 Housing
12 Housing base body
13 Connecting plate
20 Drive shaft
21 Drive journal
22 Rotary bearing
23 Cylinder drum
24 Spring
25 Pressure ring
26 Rotation axis of drive shaft

27 Working chamber
30 Working piston
31 Slide shoe
32 Pivot cradle
33 Retraction plate
34 Control plate
35 Pivot axis
40 Actuating piston
41 Closing screw
42 Cylinder chamber
43 Fluid channel
44 Diameter of fluid channel
45 Piston rod
50 Cylinder bore
51 Internal thread
52 Thread depth
53 Circular cylindrical region
54 Thread turn
55 Thread tip
56 Center axis of cylinder bore
60 Recess
60' Recess (second embodiment)
61 Depth of recess
62 Floor region
63 Width in region of thread tips
64 Side wall
70 Milling cutter
71 Cutting diameter
72 Axis of symmetry

What is claimed is:

1. An axial piston machine, comprising:

a housing including:

a cylinder bore, an end of the cylinder bore open to an outside of the housing and having an internal thread;

a recess in a region of the internal thread, the recess deeper than a thread depth of the internal thread so that a floor region of the recess is free of thread turns; and a fluid channel that opens into the floor region of the recess;

an actuating piston linearly movable in the cylinder bore, and configured to adjust a displacement volume of the axial piston machine; and a closing screw screwed into the internal thread of the end of the cylinder bore to form a closed cylinder chamber between the actuating piston and the closing screw, the fluid channel fluidically connected to the cylinder chamber.

2. The axial piston machine of claim 1, wherein the recess, viewed in a sectional plane oriented perpendicularly to a center axis of the cylinder bore and passing through the fluid channel, has a circular shape so that a width of the recess in a region of thread tips of the internal thread is at least twice as large as a diameter of the fluid channel.

3. The axial piston machine of claim 1, wherein:

the recess, viewed in a sectional plane containing a central axis of the cylinder bore and passing through the fluid channel, has a trapezoidal shape with a flat floor region; and the fluid channel opens fully into the flat floor region.

4. The axial piston machine of claim 3, wherein the recess is rotationally symmetrical relative to an axis of symmetry that runs parallel to the center axis of the cylinder bore and is located in an interior of the cylinder bore.

5. The axial piston machine of claim 1, wherein the recess, viewed in a sectional plane containing a center axis of the cylinder bore and passing through the fluid channel, has a circular shape.

6. The axial piston machine of claim 5, wherein the recess is rotationally symmetrical relative to an axis of symmetry that runs parallel to the center axis of the cylinder bore and is located in an interior of the cylinder bore.

* * * * *